US007608173B2

(12) United States Patent
Manens et al.

(10) Patent No.: US 7,608,173 B2
(45) Date of Patent: Oct. 27, 2009

(54) BIASED RETAINING RING

(75) Inventors: Antoine P. Manens, Mountain View, CA (US); Feng Q Liu, San Jose, CA (US); Paul D. Butterfield, San Jose, CA (US); Alain Duboust, Sunnyvale, CA (US); Rashid Mavliev, Campbell, CA (US)

(73) Assignee: Applied Materials, Inc., Santa Clara, CA (US)

( * ) Notice: Subject to any disclaimer, the term of this patent is extended or adjusted under 35 U.S.C. 154(b) by 773 days.

(21) Appl. No.: 11/003,083

(22) Filed: Dec. 2, 2004

(65) Prior Publication Data

US 2006/0137819 A1 Jun. 29, 2006

(51) Int. Cl.

| | |
|---|---|
| ***C25F 7/00*** | (2006.01) |
| ***B23H 5/06*** | (2006.01) |
| ***B23H 3/00*** | (2006.01) |
| *C25F 3/02* | (2006.01) |

(52) U.S. Cl. ..... 204/224 M; 204/297.01; 204/297.06

(58) Field of Classification Search ..... 156/345.14
See application file for complete search history.

(56) References Cited

U.S. PATENT DOCUMENTS

| | | | | |
|---|---|---|---|---|
| 5,620,581 | A * | 4/1997 | Ang | 205/96 |
| 5,738,574 | A | 4/1998 | Tolles et al. | |
| 5,744,019 | A * | 4/1998 | Ang | 205/96 |
| 5,948,204 | A * | 9/1999 | Maveety et al. | 156/345.14 |
| 6,071,388 | A * | 6/2000 | Uzoh | 204/287 |
| 6,375,549 | B1 | 4/2002 | Glashauser et al. | |
| 6,379,223 | B1 * | 4/2002 | Sun et al. | 451/41 |
| 6,390,904 | B1 | 5/2002 | Gleason et al. | |
| 6,422,927 | B1 | 7/2002 | Zuniga | |
| 6,450,868 | B1 | 9/2002 | Zuniga et al. | |
| 6,776,693 | B2 * | 8/2004 | Duboust et al. | 451/41 |
| 6,811,680 | B2 | 11/2004 | Chen et al. | |
| 6,848,970 | B2 | 2/2005 | Manens et al. | |
| 6,857,945 | B1 | 2/2005 | Chen et al. | |
| 6,869,335 | B2 * | 3/2005 | Taylor | 451/41 |
| 6,884,153 | B2 | 4/2005 | Manens et al. | |
| 6,988,942 | B2 | 1/2006 | Chen et al. | |
| 6,991,526 | B2 | 1/2006 | Sun et al. | |
| 6,991,528 | B2 | 1/2006 | Hu et al. | |
| 7,276,743 | B2 * | 10/2007 | Manens et al. | 257/127 |
| 2003/0114087 | A1 | 6/2003 | Duboust et al. | |
| 2003/0220053 | A1 | 11/2003 | Manens et al. | |
| 2004/0123951 | A1 | 7/2004 | Kramer et al. | |
| 2004/0182721 | A1 | 9/2004 | Manens et al. | |

OTHER PUBLICATIONS

International Search Report and Written Opinion of the International Search Authority, International Application No. PCT/US2005/016431, Aug. 25, 2005, 10 pp.

* cited by examiner

*Primary Examiner*—Harry D Wilkins, III
(74) *Attorney, Agent, or Firm*—Fish & Richardson

(57) ABSTRACT

A retaining ring for electrochemical mechanical processing is described. The ring has a conductive portion having an upper surface and a lower surface and an insulating portion. The insulating portion has one or more openings extending therethrough, exposing the lower surface of the conductive portion. An upper surface of the insulating portion contacts the lower surface of the conductive portion. In an electrochemical mechanical polishing process, the retaining ring can be biased separately from a substrate being polished.

23 Claims, 6 Drawing Sheets

BIASED RETAINING RING

BACKGROUND

The present invention relates to methods and apparatus for retaining a substrate during electrochemical mechanical processing.

An integrated circuit is typically formed on a substrate by the sequential deposition of conductive, semiconductive or insulative layers on a silicon wafer. One fabrication step involves depositing a filler layer over a non-planar surface, and planarizing the filler layer until the non-planar surface is exposed. For example, a conductive filler layer, such as copper, can be deposited on a patterned insulative layer to fill the trenches or holes in the insulative layer. The filler layer is then polished until the raised pattern of the insulative layer is exposed. After planarization, the portions of the conductive layer remaining between the raised pattern of the insulative layer form vias, plugs and lines that provide conductive paths between thin film circuits on the substrate. In addition, planarization is needed to planarize the substrate surface for photolithography.

Chemical mechanical polishing (CMP) is one accepted method of planarization. This planarization method typically requires that the substrate be mounted on a carrier or polishing head. The exposed surface of the substrate is placed against a rotating polishing disk pad or belt pad. The polishing pad can be either a "standard" pad or a fixed-abrasive pad. A standard pad has a durable roughened surface, whereas a fixed-abrasive pad has abrasive particles held in a containment medium. The carrier head provides a controllable load on the substrate to push it against the polishing pad. A polishing liquid, including at least one chemically reactive agent, is supplied to the surface of the polishing pad. The polishing liquid can optionally include abrasive particles, e.g., if a standard pad is used.

A variation of CMP, which is particularly useful for copper polishing, is electrochemical mechanical processing (ECMP). The ECMP process is similar to the conventional CMP process, but has been designed for copper film polishing at very low down and shear forces, and is therefore suitable for low-k/Cu technologies. In ECMP techniques, conductive material is removed from the substrate surface by electrochemical dissolution while concurrently polishing the substrate, typically with reduced mechanical abrasion as compared to conventional CMP processes. The electrochemical dissolution is performed by applying a bias between a cathode and the substrate surface and thus removing conductive material from the substrate surface into a surrounding electrolyte.

Ideally, the ECMP process polishes the substrate layer to a desired planarity and thickness. Polishing beyond this point can lead to overpolishing (removing too much) of a conductive layer or film, which can lead to increased circuit resistance. Not polishing the substrate enough, or underpolishing (removing too little) of the conductive layer, can lead to electrical shorting. Variations in the initial thickness of the substrate layer, the polishing solution composition, the polishing pad condition, the relative speed between the polishing pad and the substrate, and the load on the substrate can cause variations in the material removal rate. These variations can occur between substrates or across the radius of a single substrate, such as when a substrate is over polished in one region and underpolished in another region. The CMP apparatus can be selected to control the amount of polishing of a substrate.

SUMMARY

An independently biasable retaining ring is described. The retaining ring can be biased at a voltage separately from the substrate being polishing, affording greater control over polishing the edge of the substrate.

In general, in one aspect, the invention is directed to a retaining ring for electrochemical mechanical processing. The ring has a conductive portion having an upper surface and a lower surface and an insulating portion. The insulating portion has one or more openings extending therethrough, exposing the lower surface of the conductive portion. An upper surface of the insulating portion contacts the lower surface of the conductive portion.

Implementations of the invention may include one or more of the following features. The retaining ring can have an upper annular portion with a lower surface that contacts that conductive portion. The ring can have a conductor that extends through the upper annular portion and is in electrical contact with the conductive portion. The upper annular portion can be less conductive than the conductive portion. The openings in the insulating portion call allow the lower surface of the conductive portion to be exposed to the environment. The lower surface of the conductive portion can have recesses. The recesses can be in fluid communication with openings in the insulating portion. The insulating portion can be dimensioned so that contact between the conductive portion and a conductive element of a polishing pad assembly of a electrochemical mechanical processing system is prevented when the insulating portion is in contact with the polishing pad, even when pressure is applied to the retaining ring. The dimensions can be such that the insulating portion has a sufficient thickness to prevent the contact or the openings are sufficiently narrow to prevent the contact. The openings in the insulating portion can be holes or grooves. The conductive portion can be annular and formed of copper, gold, platinum, palladium, titanium, silver, rhodium, iridium or an alloy of one or more of these materials.

In another aspect, the invention is directed to a carrier head for electrochemical mechanical processing. The carrier head includes a base attached to a retaining ring. The retaining ring includes a conductive portion having an upper surface and a lower surface and an insulating portion. The insulating portion has one or more openings extending through the insulating portion and exposing the lower surface of the conductive portion. An upper surface of the insulating portion contacts the lower surface of the conductive portion.

In yet another aspect, the invention is directed to a system for electrochemical mechanical processing. The system includes a polishing pad support, and a carrier head. The carrier head is configured to contact the polishing pad support. The carrier head includes a base attached to a retaining ring. The retaining ring includes a conductive portion having an upper surface and a lower surface and an insulating portion. The conductive portion has one or more openings extending through the insulating portion and exposing the lower surface of the conductive portion, wherein an upper surface of the insulating portion contacts the lower surface of the conductive portion. A first voltage source is electrically coupled to the conductive portion of the retaining ring.

Implementations of the system can include one or more of the following. An anode, such as a conductive layer of a polishing pad assembly, can be supported by the polishing pad support. The anode can be electrically coupled to a second voltage source. A polishing pad assembly can include a counter-electrode. The counter-electrode is electrically coupled to a second voltage source. The system can include a controller capable of controlling the first voltage source. The system can include a current monitor configured to determine a current from the retaining ring. The conductive portion can be electrically coupled to an external roller or can be in electrical contact with a spindle. The voltage source can be configured to apply a voltage to the conductive portion between about 0V and about 1V.

In one aspect, the invention is directed to a method of operating a system for electrochemical mechanical processing. The method includes electrically biasing a polishing pad assembly at a first voltage. A conductive retaining ring is electrically biased at a second voltage, wherein the first voltage is different from the second voltage. A relative motion is created between a substrate and the polishing pad assembly, wherein the substrate is retained by the conductive retaining ring.

In another aspect the invention is direct to a method of forming a conductive retaining ring for electrochemical mechanical processing. The method includes providing a substantially annular conductive portion. An insulating portion is fastened to a lower surface of the conductive portion. The insulating portion has one or more openings extending through the insulating portion and exposing the lower surface of the conductive portion, wherein an upper surface of the insulating portion contacts the lower surface of the conductive portion.

One potential advantage of the invention is that an electrically conducting retaining ring can be electrically biased. Electrically biasing the retaining ring during ECMP polishing can improve polishing uniformity rate across the substrate (i.e., "within-wafer uniformity"), particularly at the substrate edge. Improved polishing uniformity can result in improved process stability and increased yield.

The retaining ring can be biased to a different voltage than the substrate. This can allow for tuning the rate of polishing the edge of the substrate. Tuning the rate of polishing the edge of the substrate can increase polishing uniformity across the surface of the substrate.

Using the same material to form the conducting portion of the retaining ring as the material that is being polished in the retaining ring can increase the uniformity of the polishing rate across the substrate. Using the same material also ensures chemical compatibility with the substrate, reducing the likelihood of damage to the substrate. On the other hand, using a different material, such as one that does not interact with the ECMP process, can lead to a longer useful life of the conductive portion of the retaining ring.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
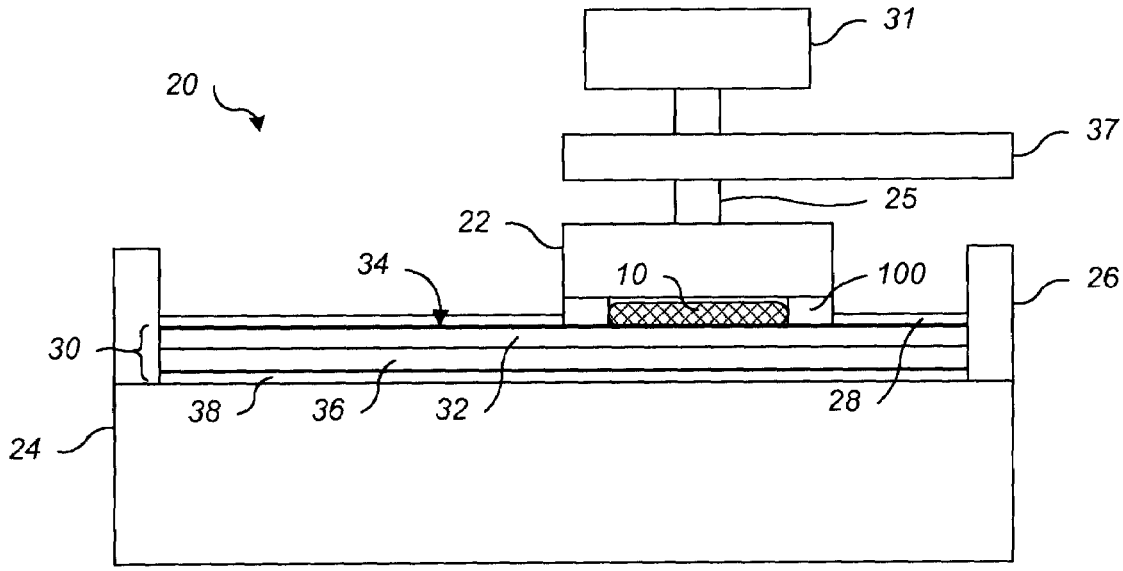
FIG. 1 is a schematic side view, partial cross-sectional, of an ECMP polishing station.

As can be seen in FIG. 1, a substrate 10 can be polished at a polishing station 20 of an ECMP apparatus. An ECMP apparatus can have multiple polishing stations, but only one is shown for the sake of simplicity. A description of a similar conventional CMP polishing apparatus can be found in U.S. Pat. No. 5,738,574, the entire disclosure of which is incorporated herein by reference. Two fundamental differences between the ECMP apparatus and a conventional CMP polishing apparatus are, first, that in the ECMP polishing process an electrolyte is used on the platen and, second, that an electrical bias is applied to the substrate. In addition, the ECMP process may be conducted at a lower rotation speed during polishing, both to reduce stress on the substrate and to prevent splashing of the electrolyte.

The polishing station 20 includes a rotatable platen 24 on which is placed a polishing pad assembly 30. Each polishing station 20 can also include a pad conditioner apparatus (not shown) to maintain the condition of the polishing pad so that it will effectively polish substrates. The edge of the platen 24 has a barrier wall or weir 26 so that a polishing electrolyte 28 can be contained on the polishing pad assembly 30 during polishing. An example of suitable electrolyte for ECMP polishing is described in U.S. patent application Ser. No. 10/038,066, filed on Jan. 3, 2002, the entirety of which is incorporated by reference. Electrolyte solutions used for electrochemical processes such as copper plating and/or copper anodic dissolution are available from Shipley Leonel, in Philadelphia, Pa., under the tradename Ultrafill 2000, and from Praxair, in Danbury, Conn., under the tradename EP3.1. Optionally, the polishing electrolyte 28 can include abrasive particles. The polishing electrolyte 28 can be supplied through ports in the surface of the polishing pad, or through a polishing liquid delivery arm (not shown).

The polishing pad assembly 30 can include a polishing layer 32 with a polishing surface 34, a non-conductive backing layer 36 that can be softer than the polishing layer 32, and a counter-electrode layer 38 which abuts the surface of platen 24. The polishing layer 32 and the backing layer 36 can be a conventional two-layer polishing pad. The polishing layer 32 can be composed of foamed or cast polyurethane, possibly with fillers, e.g., hollow microspheres, and/or a grooved surface, whereas the backing layer 36 can be composed of compressed felt fibers leached with urethane. The counter-electrode layer 38, backing layer 36 and polishing layer 32 can be assembled as a single unit, e.g., the counter-electrode 38 can be adhesively attached to the backing layer 36, and the resulting polishing pad assembly 30 can then be secured to the platen.

Figure 2A:
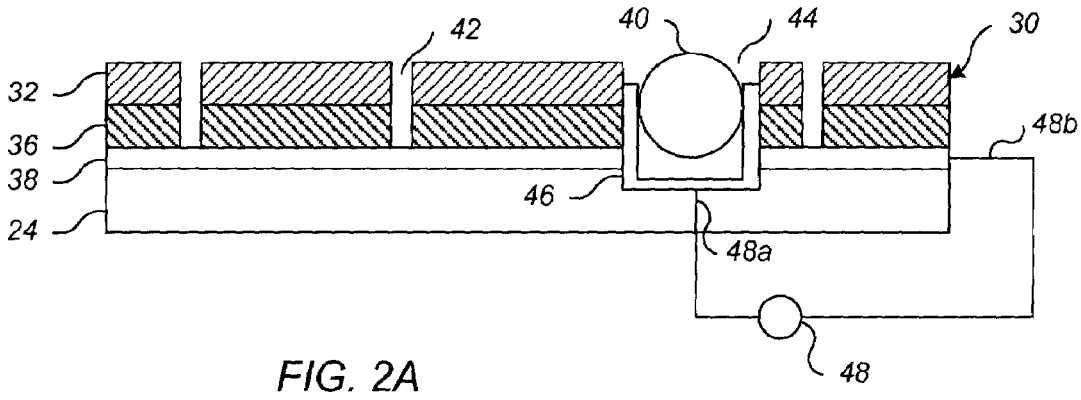
FIG. 2A is a schematic cross sectional view of an ECMP polishing pad assembly having conductive rollers.

As noted above, the ECMP apparatus applies an electrical bias to the substrate 10. A variety of techniques are available to apply this electrical bias. As shown in FIG. 2A, in one implementation, the bias is applied by electrodes that extend through apertures in a non-conductive dielectric polishing layer to contact the substrate 10 during polishing. The one or more apertures 44 can be formed through both the pad layers 32, 36 and the counter-electrode layer 38. The electrodes can be rotatable conductive spheres (rollers) 40 that are secured in the aperture 44 and extend slightly above the polishing surface 34. Each conductive roller 40 can be captured by a housing 46. In addition, perforations 42 can be formed through the polishing layer 32 and the backing layer 36 to expose the counter-electrode layer 38. A voltage source 48 can be connected to the conductive rollers 40 and the counter-electrode layer 38 by electrical contacts 48*a* and 48*b* (e.g., conductive electrical contacts embedded in a non-conductive platen), respectively, to apply a voltage difference between the rollers 40 and the counter-electrode layer 38. Such a system is described in U.S. patent application Ser. No. 10/445,239, filed May 23, 2003, the entirety of which is incorporated herein by reference.

Figure 2B:
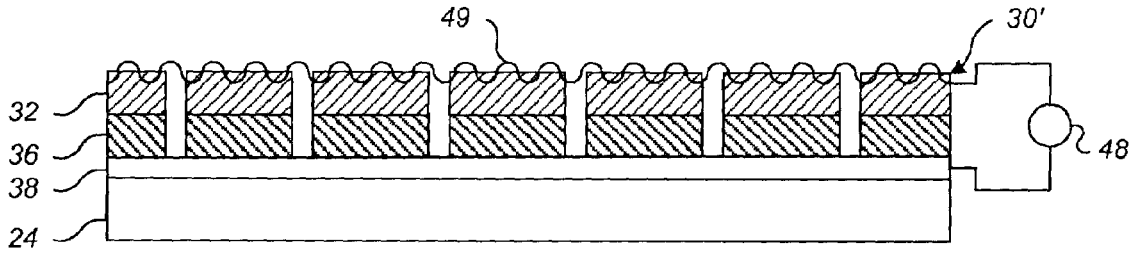
FIG. 2B is a schematic cross sectional view of an ECMP polishing pad assembly having a conductive element in or on the polishing surface of a polishing pad.

As shown in FIG. 2B, in another implementation, the bias is applied by electrodes that are embedded in a non-conductive dielectric polishing layer. The polishing pad assembly 30' includes a non-conductive polishing layer 32 with a polishing surface 34, a non-conductive backing layer 36 that can be softer than the polishing layer 32, and a counter-electrode layer 38 which abuts the surface of platen 24. A conductive element 49, such as a metal wire, is embedded in the non-conductive dielectric polishing layer 32. At least part of the conductive element 49 projects above the polishing surface 34 in order to contact the substrate during polishing. A voltage difference is applied between the conductive element 49 and the counter-electrode layer 38 by the voltage source 48. Such a polishing pad and the associated polishing system is described in the aforementioned U.S. patent application Ser. No. 10/445,239.

Figure 2C:
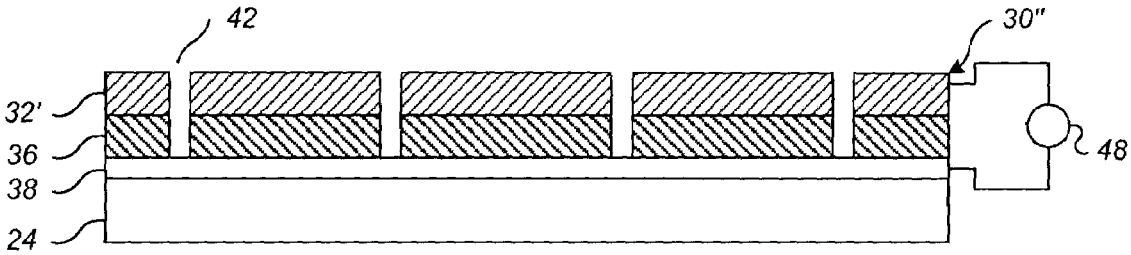
FIG. 2C is a schematic cross sectional view of an ECMP polishing pad assembly having a conductive polishing surface.

As shown in FIG. 2C, in another implementation, the polishing layer itself is conductive and applies the bias. For example, referring to FIG. 2C, the polishing pad assembly 30" includes a conductive polishing layer 32' with a polishing surface 34, a non-conductive backing layer 36, and a counter-electrode layer 38 which abuts the surface of platen 24. The conductive polishing layer 32' can be formed by dispersing conductive fillers, such as fibers or particles (including conductively coated dielectric fibers and particles) through the polishing pad. The conductive fillers can be carbon-based materials, conductive polymers, or conductive metals, e.g., gold, platinum, tin, or lead. A voltage difference is applied between the conductive polishing layer 32' and the counter-electrode layer 38 by the voltage source 48. Such a polishing pad and the associated polishing system is described in the aforementioned U.S. patent application Ser. No. 10/445,239.

Referring again to FIG. 1, a carrier head 22 brings the substrate 10 to the polishing station 20. The carrier head 22 is connected by a carrier drive shaft 25 to a carrier head rotation motor 31 so that the carrier head can independently rotate about its own axis. In addition, the carrier head 22 can independently laterally oscillate in a radial slot formed in a support plate of a rotatable multi-head carousel 37. A description of a suitable carrier head 22 can be found in U.S. Pat. Nos. 6,422,927 and 6,450,868, and in U.S. patent application Ser. No. 09/712,389, filed Nov. 13, 2000, and in U.S. patent application Ser. No. 10/810,784, filed Mar. 26, 2004, the entire disclosures of which are incorporated herein by reference.

In operation, the platen 24 is rotated about its central axis, and the carrier head 22 is rotated about its central axis and translated laterally across the polishing surface 34 of the polishing pad to provide relative motion between the substrate 10 and the polishing pad assembly 30. The carrier head 22 places a controllable pressure on the substrate 10 during polishing. The carrier head 22 also retains the substrate 10 with a retaining ring 100 that is secured to the carrier head. The retaining ring 100 has a substantially annular body.

Figure 3:
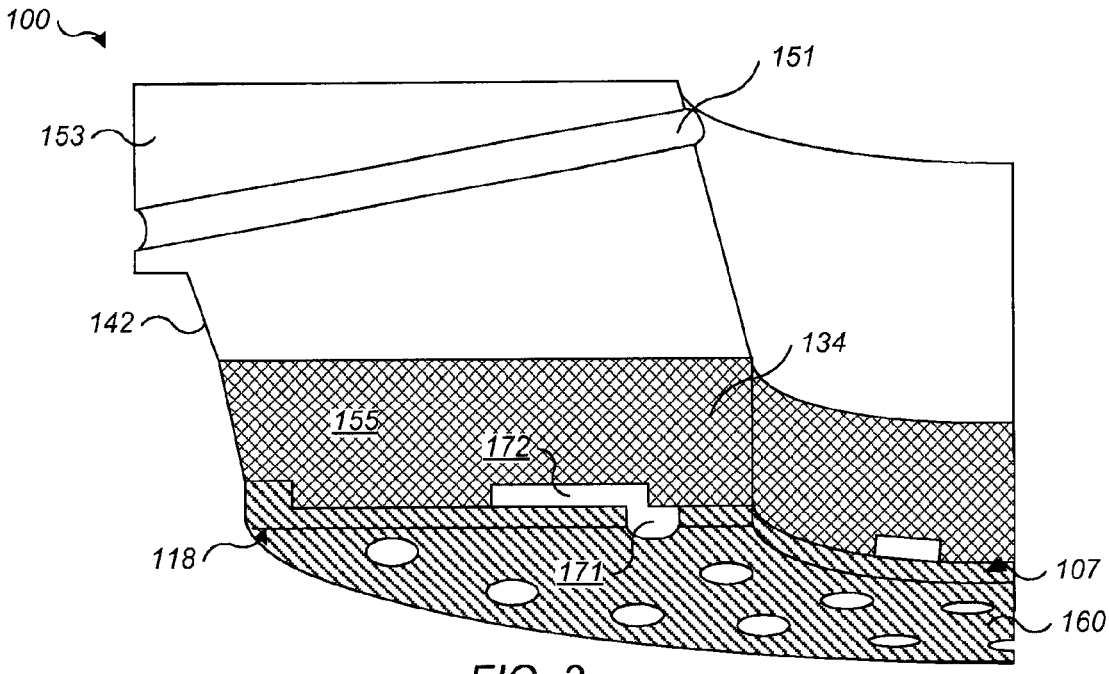
FIG. 3 is a cross sectional, partially perspective view of a retaining ring with a conductive portion and an insulating portion.
Figure 4:
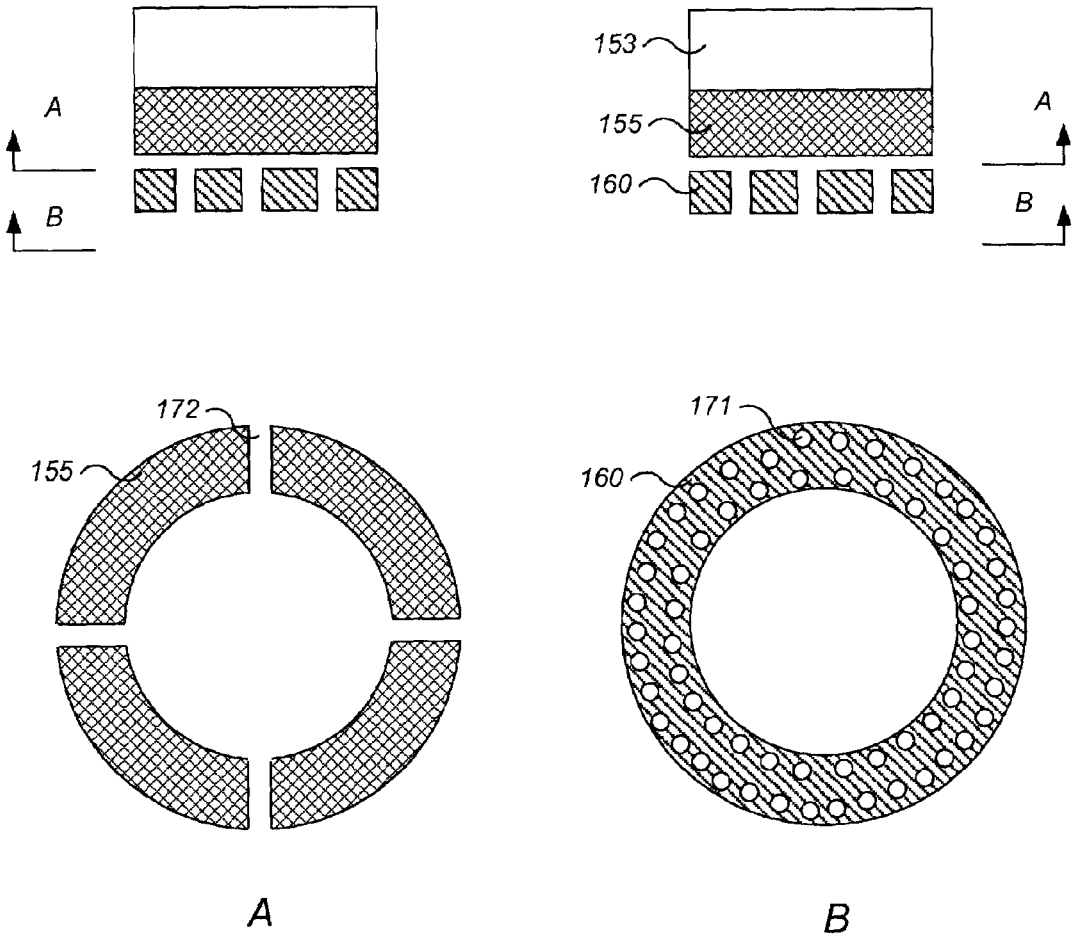
FIG. 4 is bottom view of a conductive portion and an insulating portion of a retaining ring and a cross sectional view of the retaining ring.

As shown in FIGS. 3 and 4, the retaining ring 100 includes a conductive portion 155. The conductive portion 155 can include one or more bodies formed of a conductive material. The conductive material can be a metal, such as a noble metal, including but not limited to copper, gold, platinum, palladium, rhodium or iridium. Different metals can react in one of three ways when exposed to the ECMP process. Electrolytic dissolution dissolves the metal into the electrolyte solution, oxygen evolution forms oxygen gas bubbles, and oxidation can cause the metal to become non-conducting. The one or more conductive bodies can be coupled together so that current can be transferred from one body to a neighboring body. A conductive body can be in the form of a ring, forming a conductive ring 134. The conductive ring 134 can be solid and relatively thick, or it can be a thin layer plated onto a second material.

The conductive portion 155 can be attached to an upper ring portion 153. The upper ring portion 153 can include a rigid material, such as steel, or a plastic, such as polyphenylene sulfide (PPS), polyethylene terephthalate (PET), polyetheretherketone (PEEK), polybutylene terephthalate (PBT), polytetrafluoroethylene (PTFE), polybenzimidazole (PBI), polyetherimide (PEI), or a composite material. The conductive portion 155 can be fastened to the upper ring portion 153, such as with screws, bolts or other suitable fasteners, or bonded to the upper ring portion 153, such as with an adhesive or epoxy. The upper ring portion 153 can include one or more openings or passages 151 extending from the inner surface 107 to the outer surface 142 so that fluid can pass through the upper ring portion 153.

The conductive portion 155 can include more than one conductive material. The conductive portion 155 can include a single band of a first material that interacts with the ECMP process, such as a metal that is dissolved into the electrolyte solution or forms gas bubbles and one or more bands of a second material that interacts less, e.g., has a weaker anodic or cathodic reaction, with the ECMP process, such as a metal that does not dissolve into the electrolyte solution or does not cause oxygen evolution to occur.

The conductive portion 155 has a lower surface that in part contacts an insulating portion 160. The insulating portion can 160 be press fitted to the conductive portion 155 or bonded to the conductive portion 155, such as with an adhesive or epoxy. A bottom surface 118 of the insulating portion 160 can contact the polishing pad during the polishing process. The insulating portion 160 prevents electrical contact between the conductive portion 160 and any conductive portion of the polishing pad assembly 30, such as electrodes. The insulating portion 160 can be formed of a non-conducting material, such as a plastic, for example, polyphenylene sulfide (PPS), polyethylene terephthalate (PET), polyetheretherketone (PEEK), polybutylene terephthalate (PBT), polytetrafluoroethylene (PTFE), polybenzimidazole (PBI), polyetherimide (PEI), or a composite material. The material can be inert to the polishing process. The insulating portion 160 can include a material that is less rigid than the material that forms the conductive portion 155, but the insulating portion 160 can still be relatively rigid. The insulating portion 160 can have a thickness greater than the substrate 10 being polished. A thickness greater than that of the substrate reduces the likelihood of contact between the conductive portion 160 and the substrate 10. If the insulating portion 160 is not thicker than the substrate 10, a ring of insulating material 160 can be formed at an inner edge of the retaining ring 100 to isolate the wafer from the conductive portion 155.

The retaining ring 100 has an inner diameter 107 surface that comes into contact with the substrate 10 during polishing. At least the lower portion of inner diameter 107 includes the insulating portion 160. The insulating portion 160 is sufficiently compressible to prevent the substrate 10 from chipping or cracking when an edge of the substrate 10 contacts the inner diameter 107 of the retaining ring 100. However, the retaining ring 100 should not be formed of a material that is elastic enough to extrude into the substrate receiving recess 140 when the carrier head places a downward pressure on the retaining ring 100. The retaining ring 100 should also be durable and have a low wear rate, although it is acceptable for the retaining ring 100 to wear away. The insulating portion 160 can have a shore hardness of between 75-100 shore D, such as between 80-95 shore D. The insulating portion 160 can also be positioned along other surfaces of the conductive portion 155, including the upper surface, the lower surface and the surface that forms the outer diameter 142 of the retaining ring 100.

The insulating portion 160 has one or more openings 171 that allow an electrolyte solution to contact the conductive portion 155 during polishing. The openings 171 can be perforations that are circular, oblong, rectangular or any other shape. The insulating portion 160 can have one opening 171 or multiple openings 171. The openings can include grooves, such as axial or circular grooves. The openings 171 are sufficiently small to prevent a portion of the polishing pad assembly 30 from directly contacting the conductive portion 155. Between about 5% and about 90% of the bottom surface of the conductive portion 155 can be exposed to the electrolyte solution.

Features can be formed into the bottom of the retaining ring 100. In one implementation, grooves are formed in the lower surface 118 of the insulating portion 160. The grooves enable transport of the polishing electrolyte 28 from outside of the retaining ring 100 to the recess 140 of the retaining ring.

The conductive portion 155 can have recesses 172 on its lower surface. The recesses are in fluid communication with the openings 171 in the insulating portion 160. The recesses 172 can enable fluid flow to flush air bubbles from the openings 171 during polishing. Some or all of the recesses can be in fluid communication with two or more opening 171 to facilitate the flushing of the air bubbles.

Other retaining ring configurations 100 are also suitable, such as those described in U.S. Provisional Application No. 60/571,049, filed May 13, 2004, the entire disclosure of which is incorporated herein by reference.

Figure 5:
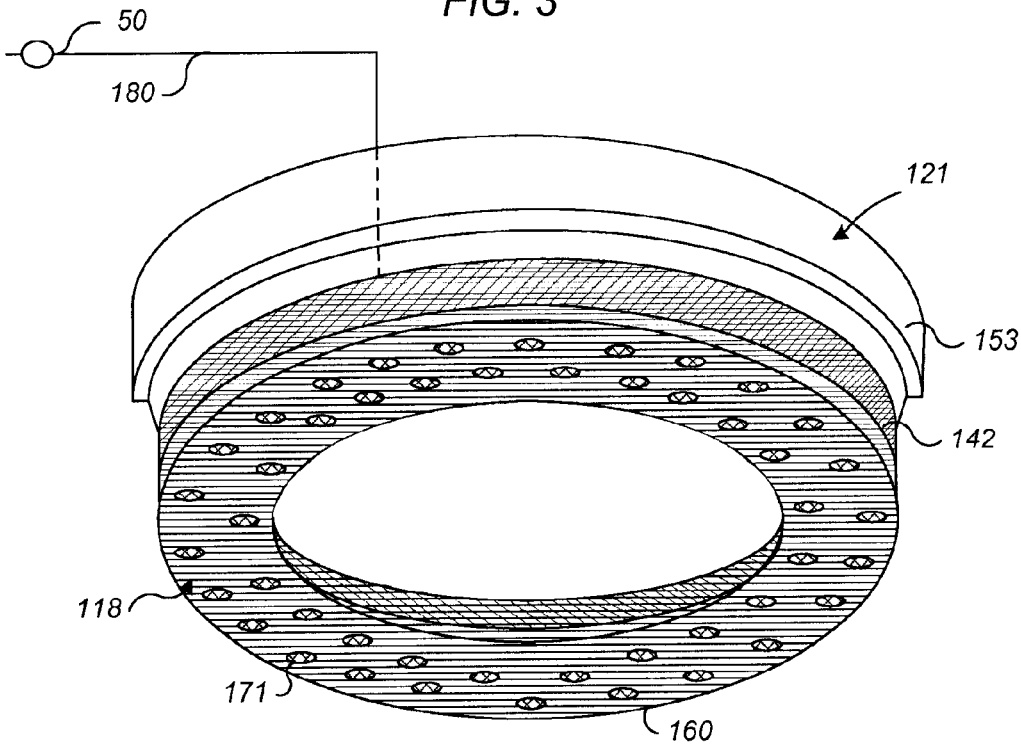
FIG. 5 is a perspective view of one implementation of a retaining ring for use with an ECMP system.
Figure 7:
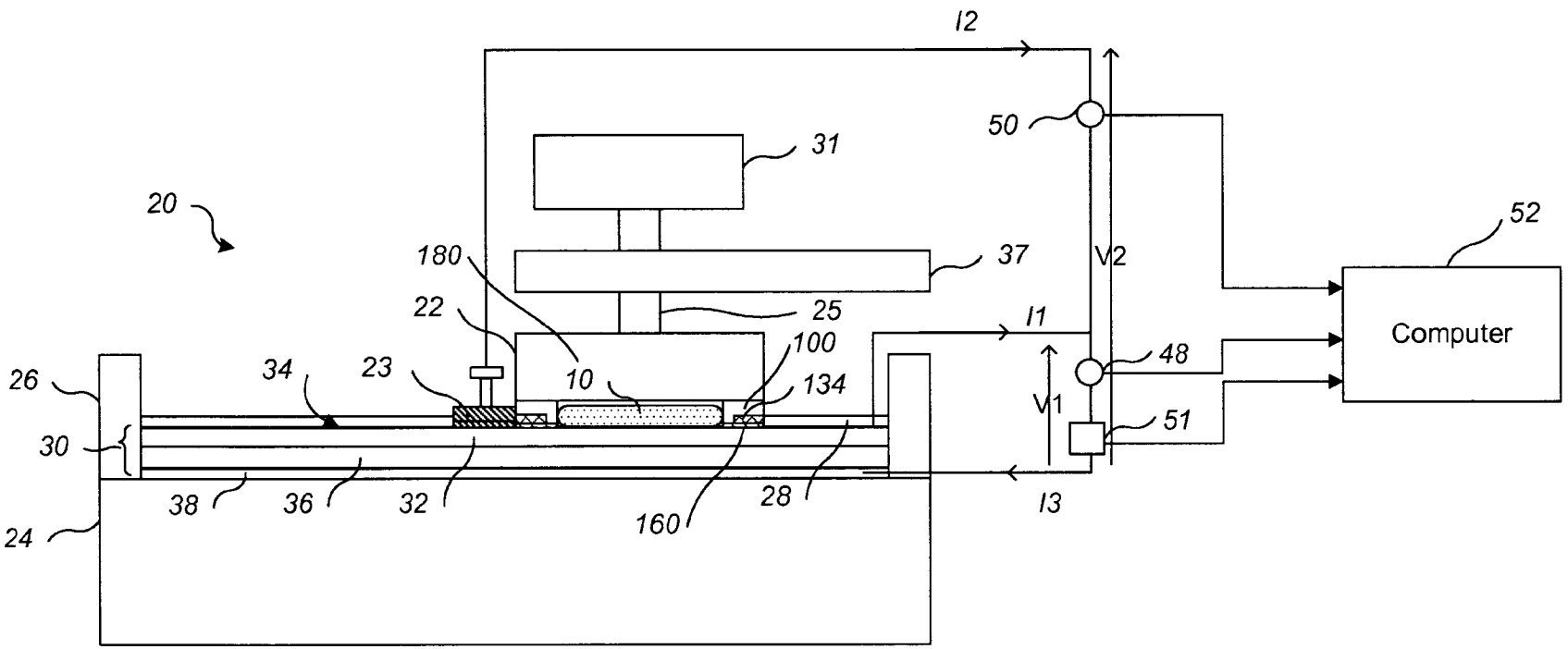

Referring to FIG. 5, the conductive portion 155 is electrically connected to a power supply, e.g., a voltage source 50. An electrical contact can be formed between the voltage source and the conductive portion 155 by an external roller or a spindle. In one implementation, the electrical connection to the ring is created by an external conductive member 23 (as shown in FIG. 7, below), such as a roller or a brush, contacting the outside of the conductive portion 155 of the ring. In other implementations, a roll-ring, slip-ring or mercury feedthrough product delivers current to the rotating head. Alternatively, the conductor 180 can include a wire that is attached to the retaining ring 100 to provide an electrical connection between the roll-ring and the conductive portion 155. In one implementation, a conductor 180 contacts the conductive portion 155 and provides an electric connection between the voltage source 50 and the conductive portion 155. The conductor 180 can extend through the upper ring portion 153 of the retaining ring 100, and through the rotating shaft of the carrier head, or along an outside wall of the upper portion 153. The conductor 180 is formed of a conductive material and can include the same material from which the conductive portion 155 is formed.

Figure 6:
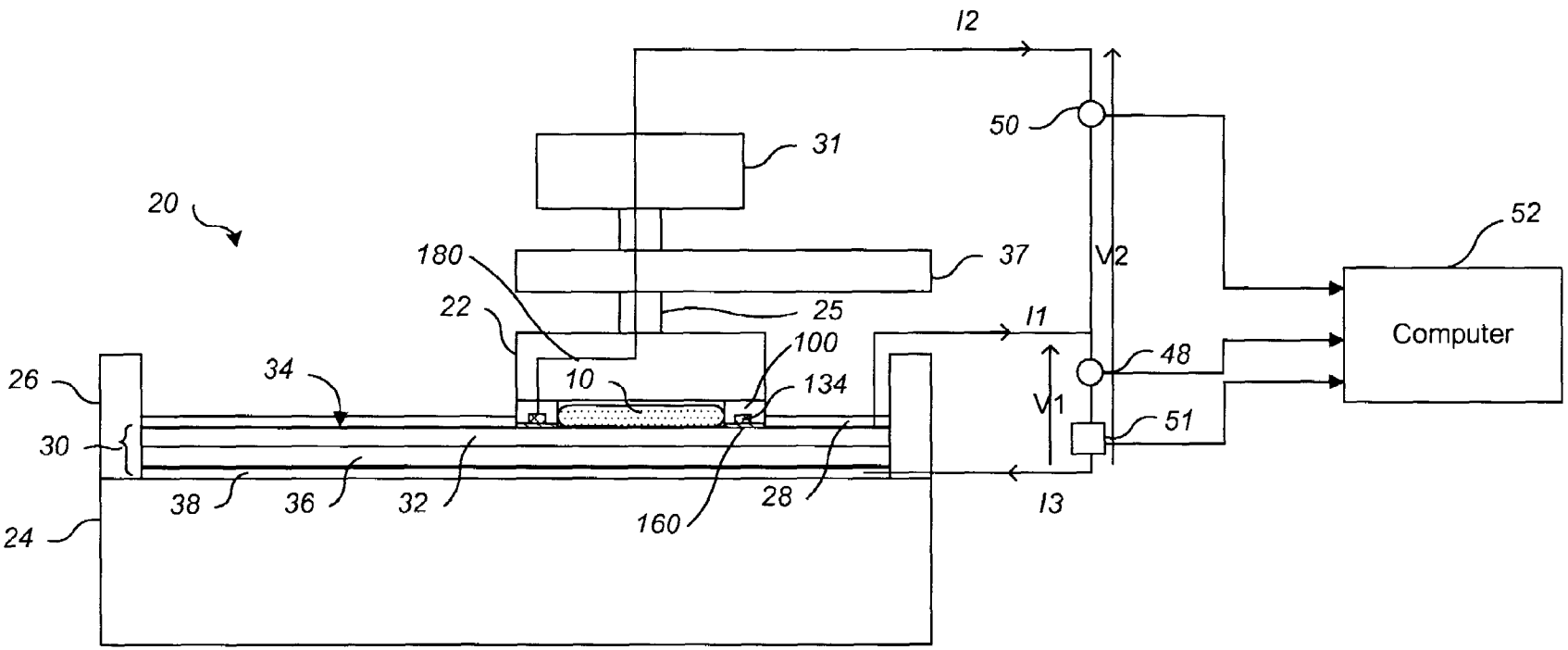
FIGS. 6 and 7 are schematic side views, partial cross-sectionals of ECMP polishing stations with an independently biasable retaining ring.

Referring to FIG. 6, the conductive portion 155 of the retaining ring 100 is in electrically coupled to a first terminal of a first voltage source 50. The conductive portion of the polishing pad assembly 30 is electrically coupled to a second terminal of the voltage source 50. A first terminal of a second voltage source 48 is electrically coupled to the first voltage source 50 and the conductive portion of the polishing pad assembly 30. A second terminal of the second voltage source 48 is electrically coupled to the counter-electrode 38 of the polishing pad assembly 30. Consequently, the voltage source 50 can bias the retaining ring 100 relative to an anode, i.e., the substrate 10 and/or the conductive portion of the polishing pad assembly 30 that contacts the substrate 10. Other configurations of biasing the retaining ring, substrate and counter-electrode layer are also suitable, such as a first voltage between the counter-electrode and the conductive portion of the retaining ring and a second voltage between the counter-electrode and the conductive portion of the polishing pad assembly or a first voltage between the conductive portion of the retaining ring and the conductive portion of the polishing pad assembly and a second voltage between the retaining ring and the counter-electrode. The voltage source 50 can bias the retaining ring 100 to a desired potential, such as between about −5V and about 5V, e.g., between about 0V and about 1V. Because the insulating portion 160 prevents the conductive portion 155 from contacting conductive elements of the polishing pad assembly 30, the retaining ring 100 is independently biased by the voltage source 50. Thus, the polishing pad assembly 30 can be biased (V1) at the same or a different potential from the retaining ring 100 (V2).

A sensor or current meter 51 can be in electrical communication with the retaining ring 100 to determine current from the retaining ring 100, as described further below. The voltage source 50, power supply 48 and current meter 51 can be in communication with a computer 52. The computer 52 can control the voltage applied to the retaining ring 100 and the substrate 10. In addition, the computer 52 can be configured to monitor the current of the system, as described below.

When the conductive portion 155 is under bias, an anodic reaction occurs on the conductive portion 155, causing cathodic current $I_3$. As the voltage on the ring is increased, the current from the ring also increases. A sensor can be in electrical contact with the conductive portion 155, to determine the current $I_2$ from the retaining ring 100. The cathodic current $I_3$ can be compensated for by measuring the current $I_2$ flowing through the retaining ring 100. The cathodic current $I_3$ minus the current from the ring $I_2$ is the dissolution current $I_1$ from the substrate. The dissolution current $I_1$ provides the profile of material removal from the substrate and can be monitored to determine the rate of material removal. There can be several cathodes within the system. The configuration of measuring current described above can be used to control the removal profile on the wafer. Other configurations are available for monitoring or controlling other parameters.

When no voltage is applied to the retaining ring 100, the performance of the retaining ring 100 is similar to a standard retaining ring. When a voltage greater than 0V is applied to the retaining ring, the biasing of the retaining ring 100 can slow the removal rate of metal from the edge of the substrate 10 during polishing. As the voltage applied to the retaining ring 100 is increased, the decrease of the removal rate also increases. When a negative voltage is applied to the retaining ring 100, the removal rate is increased at the edge of the substrate 10.

In one implementation, a standard retaining ring 100 without a conductive portion is used to polishing the substrate. A conducting member that is insulated in a manner similar to the conductive retaining ring 100 described above can be placed on the polishing surface. The conductive member can be placed close to the substrate being polished. In one implementation, the conductive member surrounds a non-conductive retaining ring. In this implementation, the conductive member need not rotate with the non-conductive retaining ring. When the carrier head moves from one platen to a subsequent platen, the conductive member can remain on the first platen, rather than following the carrier head to the next platen.

Using one or a combination of the features described above, a substrate can be polishing using the ECMP process. A carrier head transfers the substrate to the polishing station where the surface of the substrate to be processed is brought into contact with the polishing surface of the polishing pad assembly. A suitable electrolyte solution is supplied to the polishing surface. A first voltage is applied between the counter-electrode layer and the substrate. A second voltage is applied between the substrate and the conductive portion of the retaining ring. The substrate and conductive ring can be independently biased relative to the counter-electrode, and can be biased relative to each other. The carrier head can control the amount of pressure applied to the retaining ring. Even with the pressure applied by the carrier head, the conductive portions of the polishing pad apparatus do not contact the conductive portion of the retaining ring. Rather, only the electrolyte solution contacts the conductive portion. Relative motion is created between the polishing pad assembly and the substrate. The motion can be caused by one or more actions, including the carrier head moving the substrate, the carrier head rotating and the platen rotating. As the substrate is processed, copper is removed from the substrate into the electrolyte solution.

Electrically biasing the conductive portion 155 improves copper uniformity between the edge of the substrate 10 and the center of the substrate 10. Without being bound to any particular theory, including the conductive ring 134 in the retaining ring may ensure that a substantially uniform voltage is applied across the edge zone of the substrate, thereby improving uniformity of the electrolytic dissolution across the edge of the substrate. In particular, without the conductive ring, ECMP can cause overpolishing at the edges. It is hypothesized that this edge effect is created by non-uniformity of the voltage caused by the substrate edge. However, adding the conductive ring effectively controls the potential of the electrolyte at the edge of the substrate extends the edge of the conductive area, moving the source of the voltage non-uniformity away from the edge of the substrate. That is, the edge of the area to which a non-uniform voltage is applied is no longer the edge of the substrate, but beyond the edge of the substrate. Locally, at the edge of the substrate, the potential is more uniform.

The insulating portion 160 can keep the conductive portion 155 from contacting the polishing pad assembly 30. Preventing the conductive portion 155 and the polishing pad assembly 30 from direct contact can allow for independently biasing the retaining ring 100 and the substrate 10. Because the retaining ring 100 can be independently biased, the rate of material removal at the edge of the substrate can be tuned.

Forming the conductive portion 155 from the same material that is being removed from the substrate, such as copper, can increase the uniformity of the ECMP polishing process effects across the edge of the substrate and move the edge effect out to the retaining ring. Copper is typically compatible with the chemistry of the substrate. Some other metals, such as nickel, can diffuse into the substrate and cause a device formed from the substrate to be unusable. Using other materials, such as gold, platinum, palladium, rhodium, iridium, titanium, silver or an alloy of any of these materials, can increase the life of the conductive portion 155. If copper contacts the electrolyte solution, the copper can be acted upon in the same manner as the copper that is being removed from the substrate. Other non-cuprous metals are not acted upon in the same way as the copper, that is, oxygen evolution can occur instead of electrolytic dissolution, and the non-cuprous metal is not removed as quickly, if at all, from the conductive ring 134. With metals such as gold, oxygen evolution can occur.

Forming the insulating portion 160 from a material that is inert to the polishing process and not prone to chipping or cracking the substrate, provides a suitable edge for contacting the substrate 10 and decreases the likelihood of damaging the substrate 10. Securing a conductive portion 155 to a layer of such an inert material allows for both the benefits of a conductive material and the benefits of the insulating material, as described above.

A number of embodiments of the invention have been described. Nevertheless, it will be understood that various modifications may be made without departing from the spirit and scope of the invention. Accordingly, other embodiments are within the scope of the following claims.

What is claimed is:

1. A system for electrochemical mechanical processing, comprising:

a polishing pad support;

a carrier head, configured to contact the polishing pad support, the carrier head comprising:

a base; and a retaining ring attached to the base, wherein the retaining ring comprises:

a conductive portion having an upper surface and a lower surface; and an insulating portion having one or more openings extending through the insulating portion and exposing the lower surface of the conductive portion, wherein an upper surface of the insulating portion contacts the lower surface of the conductive portion; and a first voltage source electrically coupled to the conductive portion of the retaining ring.

2. The system of claim 1, further comprising an anode supported by the polishing pad support.

3. The system of claim 2, wherein the anode includes a conductive layer of a polishing pad assembly.

4. The system of claim 3, wherein the anode is electrically coupled to a second voltage source.

5. The system of claim 3, wherein the insulating portion is dimensioned such that the conductive portion does not contact the polishing pad assembly when the insulating portion contacts the polishing pad assembly.

6. The system of claim 5, wherein the insulating portion is dimensioned such that the conductive portion does not contact the polishing pad assembly when the carrier head presses the retaining ring against the polishing pad assembly.

7. The system of claim 1, further comprising a polishing pad assembly supported by the polishing pad support, wherein the polishing pad assembly includes a counter-electrode.

8. The system of claim 7, wherein the counter-electrode is electrically coupled to a second voltage source.

9. The system of claim 1, further comprising a controller, wherein the controller is capable of controlling the first voltage source.

10. The system of claim 1, further comprising a current monitor, wherein the current monitor is configured to determine a current from the retaining ring.

11. The system of claim 1, wherein the retaining ring further comprises an upper portion, wherein the upper portion contacts the conductive portion and the upper portion is configured to electrically connect the conductive portion to the voltage source.

12. The system of claim 1, wherein the openings of the insulating portion allow a portion of the lower surface to be exposed to the environment.

13. The system of claim 1, wherein the conductive portion includes one or more recesses.

14. The system of claim 13, wherein at least one of the recesses is in fluid communication with at least one of the openings in the insulating portion.

15. The system of claim 1, wherein the openings in the insulating portion are sufficiently small to prevent contact between the conductive portion and a conductive element of a polishing pad assembly when the insulating portion is in contact with the polishing pad assembly.

16. The system of claim 1, wherein the openings in the insulating portion include one or more holes.

17. The system of claim 1, wherein the openings of the insulating portion include one or more grooves.

18. The system of claim 1, wherein the conductive portion is substantially annular.

19. The system of claim 1, wherein the conductive portion is electrically coupled to an external roller.

20. The system of claim 19, wherein the voltage source is configured to apply a voltage to the conductive potion between about 0V and about 1V.

21. The system of claim 1, wherein the conductive portion is in electrical contact with a spindle.

22. The system of claim 1, wherein the conductive portion includes copper, gold, platinum, palladium, silver, rhodium or iridium.

23. A method of operating the system for electrochemical mechanical processing of claim 1, comprising:

contacting an insulating portion of the conductive retaining ring of claim 19 with a surface of a polishing pad assembly that is on the polishing pad support of the system of claim 19;

electrically biasing the polishing pad assembly at a first voltage;

electrically biasing the conductive retaining ring at a second voltage, wherein the first voltage source of claim 1 electrically biases the retaining ring at the second voltage and the first voltage is different from the second voltage; and creating a relative motion between the substrate and the polishing pad assembly, wherein the substrate is retained by the conductive retaining ring.

* * * * *

UNITED STATES PATENT AND TRADEMARK OFFICE

CERTIFICATE OF CORRECTION

PATENT NO. : 7,608,173 B2
APPLICATION NO. : 11/003083
DATED : October 27, 2009
INVENTOR(S) : Antoine P. Manens et al.

It is certified that error appears in the above-identified patent and that said Letters Patent is hereby corrected as shown below:

Column 12, Line 16 at Claim 23; replace:
"ring of claim 19 with a surface of polishing pad assem-" with
-- ring of claim 1 with a surface of polishing pad assem- --

Column 12, Line 18 at Claim 23; replace:
"claim 19;" with
-- claim 1; --

Signed and Sealed this

Twenty-second Day of December, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,608,173 B2
APPLICATION NO. : 11/003083
DATED : October 27, 2009
INVENTOR(S) : Manens et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1274 days.

Signed and Sealed this

Twelfth Day of October, 2010

David J. Kappos

David J. Kappos
*Director of the United States Patent and Trademark Office*